United States Patent [19]

Kondo et al.

[11] 3,951,735

[45] Apr. 20, 1976

[54] PROCESS FOR PREPARING GYPSUM BOARD

[75] Inventors: Minoru Kondo; Yoshinori Hatou, both of Tokyo, Japan

[73] Assignees: Nihon Cement Co. Ltd.; Asano Slate Co. Ltd., both of Tokyo, Japan

[22] Filed: May 28, 1974

[21] Appl. No.: 473,836

[30] Foreign Application Priority Data

May 29, 1973 Japan ..... 48-59383

[52] U.S. Cl. ..... 162/133; 106/112; 106/115; 156/39; 162/145; 162/153; 162/181 R; 162/155; 162/205; 264/112; 264/113

[51] Int. Cl.$^2$ ..... D21F 11/04; D21F 11/08

[58] Field of Search ..... 162/133, 145, 153, 155, 162/152, 205, 181 R; 106/111, 112, 115; 264/86, 87, 112, 113, 122; 156/39, 346

[56] References Cited

UNITED STATES PATENTS

| | | | |
|---|---|---|---|
| 1,892,873 | 1/1933 | Darrah | 162/181 R |
| 2,007,551 | 7/1935 | Tompkins | 162/133 |
| 2,076,349 | 4/1937 | Porter et al. | 106/115 |
| 2,152,670 | 4/1939 | Shutt | 106/111 |
| 2,348,829 | 5/1944 | MacArthur et al. | 162/152 X |
| 2,856,304 | 10/1958 | Kirk | 106/111 X |
| 3,004,878 | 10/1961 | Tomlinson | 162/145 X |
| 3,138,518 | 6/1964 | Greenhouse et al. | 162/133 X |
| 3,179,529 | 4/1965 | Hickey et al. | 156/39 X |
| 3,270,476 | 9/1966 | Enslen et al. | 162/205 X |
| 3,368,936 | 2/1968 | DeLong | 162/155 X |
| 3,451,832 | 6/1969 | Kuntze | 106/111 |

*Primary Examiner*—S. Leon Bashore
*Assistant Examiner*—Arthur L. Corbin
*Attorney, Agent, or Firm*—Woodhams, Blanchard and Flynn

[57] ABSTRACT

A gypsum wallboard or plasterboard having a high mechanical strength, especially high impact strength, and a large bulk density is prepared from a mixture consisting essentially of calcined gypsum, cellulosic fibers, asbestos fibers, a setting retardant for the calcined gypsum and water, by withdrawing solid components of the mixture in layer form. A plurality of the thus-obtained layers is piled to form a preform of the desired thickness and pressure-molding the preform under a molding pressure of from 10 to 400 kg/cm$^2$ to obtain the board product.

8 Claims, 2 Drawing Figures

PROCESS FOR PREPARING GYPSUM BOARD

BACKGROUND OF THE INVENTION

1. FIELD OF THE INVENTION

This invention relates to a process for preparing gypsum wallboard or plasterboard and to an apparatus for use in the process.

2. DESCRIPTION OF THE PRIOR ART

Although gypsum wallboards and plasterboards possess excellent characteristics in such properties as fireproofness, heat insulation, and dimensional stability, it is desired also to obtain further improvements in the bending strength, impact strength and water-permeability thereof. Heretofore, it has been difficult to obtain gypsum board products possessing high levels of all these desired properties.

For improving the properties of gypsum board, such as the bending strength and impact strength, it has been proposed to blend a fibrous material such as paper pulp, asbestos,, rock wool, glass fibre or synthetic resin fiber into the starting calcined gypsum material.

However, the addition of large amounts of such fibrous materials into the starting calcined gypsum lowers the mechanical strength of the board product, because a large amount of water must also simultaneously be incorporated into the starting mixture. If the amount of water incorporated is reduced in such a case, the ease of workability of the process is reduced and homogeneous distribution of the plaster and the fiber in the mixture is inhibited, whereby the fiber is non-uniformly dispersed in the resulting board product.

As the result of these disadvantages, the properties of the board product are not appreciably improved by these techniques.

SUMMARY OF THE INVENTION

An object of this invention is to provide a process, and an apparatus for use in the process, for preparing gypsum board products having a high mechanical strength, high impact strength, and large bulk density and in which fibers are uniformly distributed in the board products.

Another object of this invention is to provide a process and an apparatus for preparing gypsum board products which products exhibit less expansion as well as less shrinkage on exposure to the atmosphere in comparison with prior art pulp cement boards or asbestos cement boards and which exhibit less dimensional change after installation in a building during a fairly long time period.

A further object of this invention is to provide an improved gypsum board product having an excellent appearance and low water-absorption ratio and water permeability.

A still further object of this invention is to provide a process and an apparatus for producing such board products effectively and without causing serious environmental pollution.

This invention is based on the discovery that when cellulosic fibers are incorporated in a starting calcined gypsum aqueous slurry for improving the impact strength, the bending strength and the flexibility of the resulting gypsum board product formed therefrom, the simultaneous incorporation in said slurry of asbestos fibers prevents the separation or segregation of the cellulosic fibers in the slurry whereby there is obtained a more uniform product possessing unexpectedly improved properties in comparison with gypsum board products containing only cellulosic fibers as the sole fibrous material therein.

Thus, it is critical in this invention to employ both cellulosic fibers and asbestos fibers in the starting calcined gypsum aqueous slurry from which the final board product is made.

This invention is also based on the second discovery that a dense gypsum board containing less water when initially formed and having a reduced volume of void after drying is obtained by employing a gypsum setting retardant, or hydration retardant, for the calcined gypsum in the starting aqueous slurry containing calcined gypsum and the above mentioned additional fiber components whereby setting of the calcined gypsum is retarded for a reasonable period of time. It is also necessary to remove the solid materials from the starting slurry composition during the forming of the board and after the addition of the setting retardant, instead of applying the entire slurry to form the board product.

This invention is also based on the third discovery that a further improved plasterboard, in which the fibrous materials are combined very well with the gypsum component thereof to provide higher density, bending strength and impact strength, is obtained by pressure-molding the primary board prepared as described above.

Referring to the fibrous materials, it is critical to employ both cellulosic fibers and asbestos fibers.

Concerning the cellulosic fibers, paper pulps of natural cellulosic fibers obtained by conventional pulping of coniferous and deciduous trees can be employed in this invention. Paper pulp prepared from waste paper can also be used for this purpose. The inclusion of the cellulosic fibers in the final board product increases the impact strength and the bending strength thereof, and simultaneously improves the flexibility thereof, thereby improving its sawability and nailability. The amount of the cellulosic fibers in the starting slurry and in the final board product is in the range of from 0.5 to 30 weight percent, based on the sum of the weights of all of the components, except water, used in the starting slurry. The use of a higher amount of cellulosic fibers results in a decrease in the fireproofness of the final gypsum board product. The coexistence of asbestos fibers in the starting slurry prevents the paper pulp from segregating therein and insures that there is obtained a homogeneous intermediate gypsum board product and there is also obtained a final board product possessing improved bending strength and impact strength. The amount of the asbestos fibers is preferably in the range from 0.5 to 30 weight percent based on the sum of the weights of all of the components, except water, used in the starting slurry.

The amount of the calcined gypsum (approximately $CaSO_4 \cdot \frac{1}{2}H_2O$) employed in the starting slurry is in the range from 60 to 95 weight percent, based on the sum of the weights of all of the components, except water, used in the starting slurry.

Referring to the setting retardant of calcined gypsum, such materials are well known and the invention does not relate to a discovery concerning new retardants. There can be used various known setting retarding agents such as carboxylic acids, phosphonic acids, aminoacids, salts of these acids, sugar esters of phosphoric acid, and retarding agents of a protein or a denatured protein base. The amount of the setting retardant for calcined gypsum to be used in any particular embodiment of the process of this invention can be determined by routine calculation or experiment, taking into consideration the particular retardant used, the amount of calcined gypsum in the starting slurry, the desired time for the setting, all in accordance with conventional practice. Normally the amount of setting retardant is in the range of 0.01 to 2.0 weight percent, based on the weight of calcined gypsum in the starting slurry.

Because all of the water in the starting slurry does not accompany the solid materials used to make the board product according to this invention, the amount of water employed in the starting slurry is not critical. It is now necessary to employ a reduced amount of water in the starting slurry for preventing the possible decrease in the physical properties of the produced final board product. The use of water in an amount of from about 1 to 20 times the weight of the sum of all of the starting solid materials is acceptable. One skilled in the art can readily determine the amount of water to be employed, taking into consideration the workability of the slurry-forming operation and the prevention of the segregation of the solid components during the production steps and of the segregation thereof in the final board.

When the starting slurry composition is neutral or weakly acidic, it is preferable to add a basic substance, such as cement or an alkali, such as a calcium hydroxide, into the starting slurry composition so as to adjust the pH thereof to be weakly basic, to reduce corrosion of the apparatus.

For depositing the solid components from the starting aqueous slurry composition in the form of a film or a layer of solids wet with water, the below-mentioned two processes are exemplified.

In the first process, a film containing the solid components of the starting aqueous slurry composition, which film is wet with water, is formed on a rotary drum provided with a porous filter medium surrounding the rotary drum, by immersing in the slurry at least a substantial part of the lower portion of the rotary drum, rotating the rotary drum about a horizontal axis, filtering the slurry composition on the filter medium and thereby removing the freely drainable water phase, which passes through the filter medium into the interior of the rotary drum, whereby to form on the upper portion of the rotary drum a film of solids which are wet with water. This operation is essentially one of continuous filtration, such as is commonly performed using continuous vacuum filters and, thus, it does not require further detailed discussion.

The film thus-formed on the drum is generally of a thickness of from about 0.2 mm to about 0.3 mm. This film is removed from the drum, is then further dehydrated and then a plurality of such films are piled to obtain an intermediate board or preform of the desired thickness.

This board or preform is cut into pieces of the desired dimensions, and then is pressure molded and dried to produce the final gypsum board product.

BRIEF DESCRIPTION OF THE DRAWING

In FIG. 1, numeral 1 indicates a mixer in which calcined gypsum (approximately $CaSO_4 \cdot \frac{1}{2}H_2O$), the cellulosic and asbestos fibers, a setting retardant of the calcined gypsum and water are mixed in a desired ratio.

Figure 1:
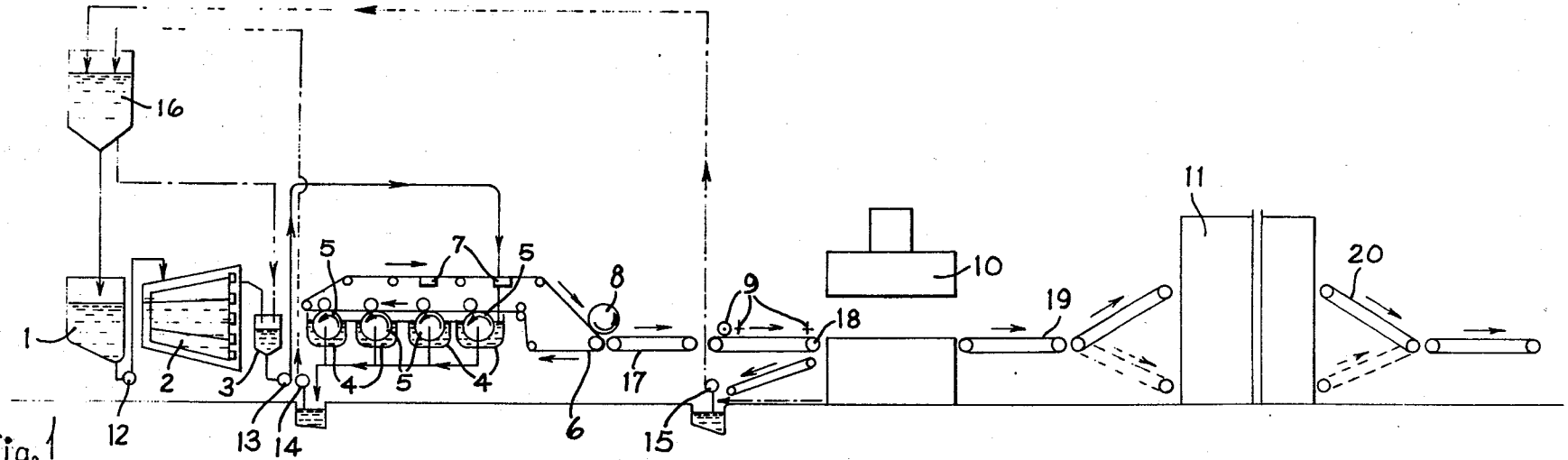
FIG. 1 illustrates schematically an apparatus for producing the gypsum board product according to this invention.

Numeral 2 indicates a stuff chest or reservoir for the mixed slurry, in which the slurry composition blended in the mixer 1 is further stirred and intimately mixed so that a homogeneous slurry is formed and separation of the solid components is prevented.

Numeral 3 indicates a mixing tank, 4 are slurry vats, and 5 are rotary filter drums disposed in the vats and which scoop the solid matters from the slurry to form films thereof on the upper surfaces of the drums as above described. Numeral 6 indicates an endless porous belt conveyor which receives the films from the drums. The conveyor 6 is provided with suction units 7 which are connected to a vacuum pump (not shown). The layers or films formed on the drums 5 are deposited on the belt 6 in superposed relation thereon and the same are further dewatered by the suction units 7.

Numeral 8 indicates a press roll for pressing further the multi-layer sheet formed on the belt conveyor 6 to a predetermined thickness, as above described.

Numeral 9 indicates a cutter which is used for cutting the pressed multi-layer sheet to a predetermined dimension to produce an intermediate board product or preform. Numerals 17 and 18 indicate conveyors.

Numeral 10 indicates a pressure molding device, 19 is a conveyor for conveying the molded boards, numeral 11 indicates a dryer and 20 is a conveyor for conveying the dried final board products. Numerals 12 and 13 are slurry pumps, numerals 14 and 15 are pumps for pumping the circulating water and numeral 16 indicates a reservoir for water.

The operation of the above-described apparatus is as follows.

The starting materials are mixed well in a desired weight ratio in the mixer 1 and the resultant slurry is fed into the stuff chest 2 by the slurry pump 12. In the chest 1 the slurry is further mixed by stirring so that a uniform dispersion of it can be fed continuously to the following step.

Then the slurry is diluted with water to form a slurry of predetermined concentration in the mixing tank 3 and this slurry is continuously fed into the slurry vats 4 at an essentially constant feed rate.

The solid components of the mixture slurry composition are deposited on the peripheries of the drums 5 as above described.

The films, containing the solid components which are wet with water and which are formed on the peripheries of the rotary drums 5, usually have a thickness in the range of about 0.2 to 0.3 mm.

Referring to the rotary drums 5, four of which are shown in FIG. 1, the number thereof is variable depending on desired features of the board product. In general, it is preferred to employ from 1 to 8 rotary drums 5 in the process of this invention. The films containing the solid components which are formed on the peripheries of the rotary drums are transferred onto the belt conveyor 6 and are superposed one on top of the other. The superposed films travel with the conveyor belt over the suction units 7 to the press roll 8 and then are pressed by the press roll 8 to form a unitary intermediate product.

The films formed on the drums 5, containing the solid components wet with water, lose some more water as they pass over the suction units 7, as they travel on the belt conveyor 6. They are then pressed by the press roll 8, on which the piled films containing the solid components are further piled to form the intermediate plasterboard product of a predetermined thickness. At this time the intermediate board product still contains sufficient water adhering to the surfaces of the solids thereof that the calcined gypsum can be transformed to calcium sulfate dihydrate during the subsequent steps of the process.

The thus-obtained intermediate board is cut by the cutter 9 to the desired dimensions and is then molded under pressure by the pressure-molding device 10 to obtain a second intermediate pressed board product. The pressure used in the device 10 is preferably from about 10 to about 400 kg/cm².

The second intermediate board product is dried in the dryer 11 to produce the final board product of this invention.

Some of the particles of calcined gypsum present in the initial slurry may be removed with the water which is removed at various stages of the process. These calcined gypsum particles and the water can be recycled and again used as the starting materials of the process of this invention.

The final gypsum board product produced by the process of this invention has a much higher bulk density than conventional gypsum boards, it has a higher bending strength than conventional gypsum boards and it further has very good surface features and smoothness, because the gypsum board according to this invention is produced by dewatering films containing the solid components by means of rotary drums having porous filter media surrounding them, piling the films in a desired thickness and then pressure-molding the resulting piled films, with the result that the fibers in tthe gypsum board of this invention are oriented to the longitudinal direction of the final board product and that the adherence of the fibers to the gypsum component is very much improved as a consequence of the application of the pressure during molding.

In addition, the gypsum board has superior sawing ability and nailability.

According to this invention, gypsum boards can be produced with high productivity and environmental pollution can be effectively minimized because the water used for the production as well as the drained solid components including plaster are recovered for reuse in a so-called closed system.

The gypsum board of this invention has a high fireproofness because it is produced without using any board-holding paper, i.e. the final board product does not have papeer layers adhered to its external surfaces, as in conventional prior art gypsum board products.

Furthermore, the gypsum board of this invention exhibits less expansion as well as less shrinkage on exposure to the atmosphere, in comparison with cellulosic fiber cement boards or asbestos cement boards and its dimensions do not change after long passage of time because it contains relatively few voids at the interconnected portions of the gypsum boards or at crevices at the points of receiving nails therein.

Furthermore, the plasterboard of this invention has a low water absorption ratio and water permeability, because it has undergone the step of pressure molding and its bulk density is high.

Figure 2:
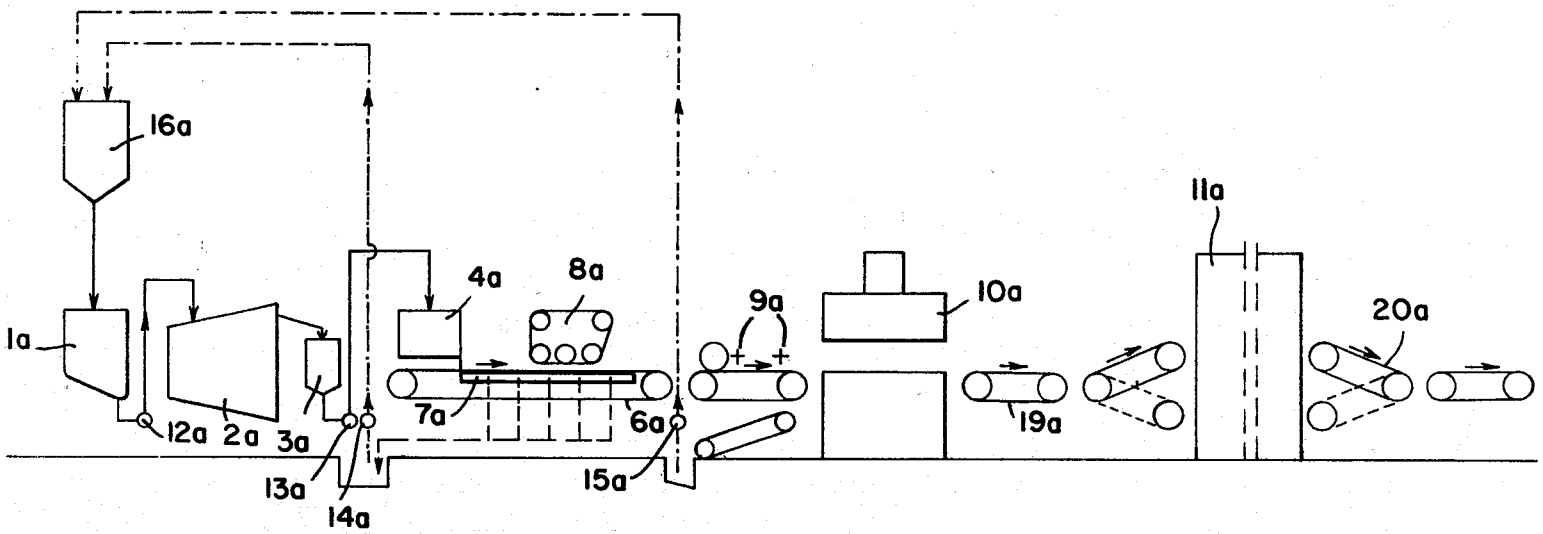
FIG. 2 illustrates a modified apparatus.

A second process for removing solid components of the starting slurry composition is explained in the following description by reference to FIG. 2. In FIG. 2, the parts corresponding to those described in FIG. 1 are identified by the same reference numerals with the suffix *a* added thereto. This process also employs, in common with the first process illustrated to the drawing, the steps of stirring a mixture of the starting materials in a mixer 1*a*, transferring the slurry into a stuff chest 2*a* and diluting the mixture with water in mixer 3*a* and supplying the slurry to the following solid removal device.

However, in the step of removing the solids from the slurry, the slurry is fed onto an endless belt conveyor 6*a*, the belt of which is composed of an endless metal net having openings for draining water therethrough while retaining solids thereon. On the opposite side of the belt, there are provided suction units 7*a* for effecting the vacuum suction dewatering of the slurry during the passage thereof on the belt over the suction units. The preliminarily dewatered layer can be further pressed by means of a roller-press 8*a* to expel excess water to obtain an intermediate board of a desired thickness.

The thus-obtained intermediate board is cut into pieces of desired dimensions by means of a cutter 9*a* and then, these pieces are pressure-molded by means of a pressure-molding machine 10*a* to obtain the second intermediate board product. The pressure therein applied is preferably in the same range of 10 to 400 kg/cm² as in the above-mentioned first process.

The thus-obtained second intermediate board is dried in a dryer 11*a* to obtain the final gypsum board product of this invention as carried out in the above-mentioned first process.

According to this invention, a gypsum board can be produced with high productivity, because solid matters from a slurry of raw materials is retained on the surface of the belt conveyor provided with vacuum dewatering means to obtain a first intermediate board product of predetermined thickness and followed by a step of pressure molding. Further, a gypsum board produced by this invention has high fireproofness because it is produced without using any board-holding paper and it has superior sawing ability and nailability and a high bending strength, because there exists in the final board product both cellulosic fibers and asbestos fibers in uniform homogeneous admixture with the calcium sulfate dihydrate.

The invention is further described by reference to the following illustrative Examples and Comparative Examples.

EXAMPLES 1 THROUGH 9 AND COMPARATIVE EXAMPLES 1 AND 2

Calcined gypsum, paper pulp, asbestos fibers, water, a setting retardant for the calcined gypsum and pH-controlling aents were blended in the amounts listed in Table 1. In Examples 1 to 7 gypsum board products according to this invention were prepared using an apparatus employing four rotary drums as illustrated in the drawing. In Examples 8 and 9 the gypsum boards were prepared by the above-mentioned second process using a belt conveyor provided with an endless conveyor belt of a metal net as a filter medium. In both processes of Examples 1 to 9, the first intermediate board product piled by the press roll 8, was adjusted to be 6 mm in thickness. The pressure used during the pressure-molding are listed in Table 1.

In Examples 1 to 7 of Table 2, there are shown the values of bulk density, bending strength, impact strength by the Charpy method, expansion ratio on exposure to atmosphere and shrinkage ratio on dryness of the individual plasterboards of this invention.

In Table 2, Comparative Test 1 shows the corresponding values of a conventional gypsum board measured under the same conditions.

In Table 2, Comparative Test 2 shows the corresponding values of a gypsum board prepared according to the process of this invention using the rotary drum apparatus of the drawing, except thet there was used a pressure value on pressuremolding, which did not lie with the preferred range employed in this invention.

In Table 2, Examples 8 and 9 show the corresponding values of the gypsum boards prepared by the abovementioned second process using a belt conveyor provided with an endless conveyor belt of a metal net as a filter medium. The values were measured in the similar manner as in Examples 1 to 7. In Table 1, the amounts of the calcined gypsum, the paper pulp and asbestos fibers are expressed as percentages, based on the total weight of the calcined gypsum, paper pulp and asbestos fibers used.

The amount of water expressed in Table 1 is a multiplier. The total weight of all the solid materials used is multiplied by this multiplier to obtain the total weight of water used.

The cement and slaked lime are added as pH-controlling agents, while potassium citrate is a setting retardant for the calcined gypsum.

cause substantially all of the hydration of the calcined gypsum to occur after the board product has left the pressure molding device and before it enters the drier. Because this will depend on the specific setting retardant used and the process time, in any specific installation routine experimentation will establish the required amount of setting retardant required.

The embodiments of the invention in which an exclusive property or privilege is claimed are defined as follows:

1. A process for making a compressed gypsum board having exposed gypsum surfaces, which comprises:

forming an aqueous slurry consisting essentially of water, setting retardant for calcined gypsum, cellulosic fibers, asbestos fibers and calcined gypsum, said slurry containing, on a water-free basis, from 0.5 to 30 weight percent of said cellulosic fibers, from 0.5 to 30 weight percent of asbestos fibers and from 60 to 95 weight percent of calcined gypsum;

continuously depositing at least one layer of said slurry directly onto a moving porous surface capable of passing drainable water therethrough and retaining the solids, thereon, and draining water from said layer while same is on said surface, then removing said layer from said surface and obtaining an intermediate gypsum board product having exposed gypsum surfaces free of covering layers Table 1

| | Composition | | | | | | | |
|---|---|---|---|---|---|---|---|---|
| | (a) Calcined gypsum (%) based on (a)+(b)+(c) | (b) Paper pulp (%) based on (a)+(b)+(c) | (c) Asbestos (%) based on (a)+(b)+(c) | (d) Cement (%) based on (a) | (e) Slaked lime (%) based on (a) | (f) Potassium citrate (%) based on (a) | Water times | Pressure applied in molding (kg/cm²) |
| Example 1 | 90 | 5 | 5 | 5 | 0 | 0.5 | 5 | 100 |
| Example 2 | 75 | 20 | 5 | 0 | 5 | 0.1 | 5 | 100 |
| Example 3 | 65 | 30 | 5 | 0 | 2 | 0.05 | 5 | 20 |
| Example 4 | 75 | 5 | 20 | 5 | 0 | 1.0 | 10 | 100 |
| Example 5 | 68 | 2 | 30 | 0 | 2 | 0.3 | 10 | 100 |
| Example 6 | 80 | 5 | 15 | 0 | 2 | 0.1 | 10 | 200 |
| Example 7 | 80 | 5 | 15 | 0 | 2 | 0.1 | 10 | 300 |
| Example 8 | 90 | 5 | 5 | 5 | 0 | 0.3 | 3 | 100 |
| Example 9 | 75 | 5 | 20 | 5 | 0 | 0.3 | 3 | 100 |
| Comparative Test 1 | (Presently marketed gypsum board) | | | | | | | |
| Comparative Test 2 | 90 | 5 | 5 | 5 | 0 | 0.5 | 5 | 5 |

Table 2

| | Bulk Density (g/cm³) | Bending strength (kg/cm²) | Impact strength by Charpy method (kg-cm/cm²) | Expansion on exposure to humidity (mm/M) | Shrinkage on drying (mm/M) |
|---|---|---|---|---|---|
| Example 1 | 1.5 | 240 | 2.7 | 0.6 | 0.5 |
| Example 2 | 1.3 | 252 | 3.5 | 1.0 | 0.8 |
| Example 3 | 1.1 | 190 | 4.3 | 1.3 | 1.1 |
| Example 4 | 1.4 | 280 | 4.8 | 0.8 | 0.7 |
| Example 5 | 1.3 | 276 | 5.2 | 0.9 | 0.7 |
| Example 6 | 1.5 | 332 | 5.0 | 0.7 | 0.7 |
| Example 7 | 1.6 | 364 | 5.3 | 0.7 | 0.6 |
| Example 8 | 1.4 | 160 | 2.2 | 0.9 | 0.7 |
| Example 9 | 1.3 | 179 | 3.9 | 1.0 | 0.9 |
| Comparative Test 1 | 0.74 | 86 | 1.5 | 0.5 | 0.3 |
| Comparative Test 2 | 1.0 | 76 | 1.1 | 1.1 | 1.0 |

The amount of setting retardant employed in the starting slurry is selected to be an amount effective to and containing sufficient water adhering to the surfaces of the solids to cure the gypsum;

pressure molding said intermediate gypsum board product under a molding pressure of from 10 to 400 kg/cm² to obtain a second intermediate compressed board product;

then drying said second intermediate compressed board product to obtain a final gypsum board product.

2. The process according to claim 1, in which the slurry is formed into a layer and is simultaneously dewatered by rotating about a horizontal axis a rotary drum whose lower portion is immersed in said slurry and whose periphery comprises a filter medium so that the slurry is filtered by the filter medium and a drainable water in said slurry is filtered into the interior of the drum, leaving on the periphery of the drum a layer of the solid components of said slurry.

3. The process of claim 2 in which separate layers are formed on from one to eight rotary drums in series and said layers are piled on top of one another.

4. The process of claim 3, in which the superposed layers are conveyed on a porous conveyor belt and are further dewatered by suction means as they move with said belt.

5. The process according to claim 1, in which the slurry is formed into a layer and is simultaneously dewatered by continuously feeding the slurry onto a moving porous conveyor belt provided with suction means for dewatering the slurry as it moves with the conveyor belt, thereby removing the drainable water contained in the slurry to obtain the intermediate board product.

6. The process according to claim 1, including the step of roll pressing the intermediate board product to a predetermined thickness and then cutting the intermediate board product to pieces of desired dimensions prior to said pressure molding step.

7. The process according to claim 4, including the step of roll pressing the intermediate board product to a predetermined thickness and then cutting the intermediate board product to pieces of desired dimensions prior to said pressure molding step.

8. The process according to claim 5, including the step of roll pressing the intermediate board product to a predetermined thickness and then cutting the intermediate board product to pieces of desired dimensions prior to said pressure molding step.

* * * * *